US010350781B2

(12) United States Patent
Campanini

(10) Patent No.: US 10,350,781 B2
(45) Date of Patent: Jul. 16, 2019

(54) CUTTING APPARATUS

(71) Applicant: Custom S.p.A., Fontevivo (IT)

(72) Inventor: Alberto Campanini, Fidenza (IT)

(73) Assignee: Custom S.p.A. (IT)

( * ) Notice: Subject to any disclaimer, the term of this patent is extended or adjusted under 35 U.S.C. 154(b) by 27 days.

(21) Appl. No.: 14/419,496

(22) PCT Filed: Aug. 5, 2013

(86) PCT No.: PCT/IB2013/056411
§ 371 (c)(1),
(2) Date: Feb. 4, 2015

(87) PCT Pub. No.: WO2014/024120
PCT Pub. Date: Feb. 13, 2014

(65) Prior Publication Data

US 2015/0221138 A1 Aug. 6, 2015

(30) Foreign Application Priority Data

Aug. 9, 2012 (IT) ..... MO2012A0197

(51) Int. Cl.

| | |
|---|---|
| ***B26F 3/00*** | (2006.01) |
| ***B26F 3/02*** | (2006.01) |
| ***B26D 1/02*** | (2006.01) |
| ***B26D 7/00*** | (2006.01) |

(Continued)

(52) U.S. Cl.
CPC ..... *B26F 3/02* (2013.01); *B26D 1/025* (2013.01); *B26D 7/00* (2013.01); *B26F 3/002* (2013.01);

(Continued)

(58) Field of Classification Search
CPC ..... Y10T 225/217; Y10T 225/218; Y10T 225/215; Y10T 225/216; Y10T 225/22; Y10T 225/221; Y10T 225/276; Y10T 225/295; B26D 5/10; B26D 1/05; B26D 1/025; G07B 5/02; B26F 3/002; B26F 3/02; B65H 35/0086
See application file for complete search history.

(56) References Cited

U.S. PATENT DOCUMENTS 2,125,736 A * 8/1938 Murray ..... B65H 35/008 225/20
2,663,369 A 12/1953 Erhardt
(Continued)

FOREIGN PATENT DOCUMENTS

DE 29902047 U1 * 6/2000 ..... B65H 35/002

*Primary Examiner* — Jennifer B Swinney
(74) *Attorney, Agent, or Firm* — Laubscher & Laubscher, P.C.

(57) ABSTRACT

A cutting apparatus is disclosed for separating, intermittently, receipts or tickets from a continuous strip of material, in which the strip is cut by a stationary blade when the user tensions the strip by pulling an end thereof, in which the cut margin of the strip is disengaged from the blade by virtue of an elastically movable element that has a non cutting edge extending in length next to the entire length of a cutting edge of the blade, and in which the strip tensioned during the cut pushes the non cutting edge in a recessing position with respect to the cutting edge and after cutting the non cutting edge returns elastically to a protruding position beyond the cutting edge.

12 Claims, 4 Drawing Sheets

(51) Int. Cl.
*B65H 35/00* (2006.01)
*G07B 5/02* (2006.01)
*B26D 5/10* (2006.01)

(52) U.S. Cl.
CPC ..... *B65H 35/0006* (2013.01); *B65H 35/008* (2013.01); *G07B 5/02* (2013.01); *B26D 5/10* (2013.01); *B65H 2701/1936* (2013.01); *Y10T 225/217* (2015.04)

(56) References Cited

U.S. PATENT DOCUMENTS 2,798,552 A * 7/1957 Aldrich ..... B65H 35/0026 225/19
3,731,863 A * 5/1973 Nausedas ..... B65H 35/0006 225/20
3,991,923 A 11/1976 Nishikawa
4,035,808 A * 7/1977 Karp ..... B65C 9/46 101/47
4,787,542 A * 11/1988 Ruff ..... B65H 35/002 225/1
5,407,115 A 4/1995 Blalock et al.
6,491,082 B1 * 12/2002 Fu ..... B65H 35/0033 156/523
6,598,773 B1 7/2003 Daret et al.
6,848,779 B2 * 2/2005 Lo ..... B41J 3/4075 101/484
2007/0028739 A1 * 2/2007 Kawaguchi ..... B26D 1/085 83/651
2007/0267455 A1 * 11/2007 Huang ..... B26D 7/22 225/20
2008/0087701 A1 * 4/2008 Hsieh ..... B26F 3/02 225/39

* cited by examiner

CUTTING APPARATUS

This application is a § 371 National Stage Entry of PCT International Application No. PCT/IB2013/056411 filed Aug. 5, 2013. PCT/IB2013/056411 claims priority to IT Application No. MO2012A000197 filed Aug. 9, 2012. The entire contents of these applications are incorporated herein by reference.

BACKGROUND OF THE INVENTION

The invention relates to a cutting apparatus, in particular for cutting receipts or tickets printed from a continuous strip of material.

Specifically, but not exclusively, the invention can be applied in a distributor of receipts or tickets located in a public place, for example in a self-service fuel dispenser that automatically generates a payment receipt for the customer.

The invention can be used in any situation in which it is necessary to separate, intermittently, receipts or tickets from a relatively long continuous strip.

In particular, this invention refers to a cutting apparatus made in accordance with the preamble to the first claim.

Such a cutting apparatus is already known, for example from patent publication U.S. Pat. No. 5,407,115, in which the receipt or ticket is separated by the user, who tensions the strip by pulling a strip end that protrudes from a paper outlet and causing cutting along a stationary blade.

One of the problems of known cutting apparatuses of this type is the risk that the paper remains stuck to the cutting edge of the stationary blade causing, at the request of the emission of a subsequent ticket, an irregular or undesired movement of the strip, with possible jamming and/or failed dispensing of the ticket.

SUMMARY OF THE INVENTION

One object of the invention is to provide a solution to the aforesaid problem of the prior art.

One advantage is ensuring that the strip detaches from the cutting edge of the blade before a new ticket or receipt is issued.

One advantage is to make a cutting apparatus, which is usable in a dispenser of tickets or receipts separated from a continuous strip of material that is able to ensure regular and orderly movement of the strip.

One advantage is to give rise to a constructionally simple and cheap cutting apparatus.

Such objects and advantages, and still others, are achieved by the cutting apparatus according to any one of the claims set out below.

In one example, the cutting apparatus includes a stationary blade with which an elastically movable element is operationally associated. The stationary blade has a cutting edge that cuts a continuous strip of material when the user tensions the strip by pulling an end thereof, and the elastically movable element has a non-cutting edge that extends in length next to the entire length or at least most of the length of the cutting edge and that, during cutting, it is pushed by the tensioned strip to an (end) position, at least partially receding or flush with respect to the cutting edge. The movable element is provided with an elastic element that, after cutting, returns the movable element elastically back to a position in which the non-cutting edge protrudes at least partially beyond the cutting edge to disengage the cut border of the strip from the cutting edge.

BRIEF DESCRIPTION OF THE DRAWINGS

The invention can be better understood and implemented with reference to the attached drawings that illustrate a non-limiting example thereof.

DETAILED DESCRIPTION

Figure 1:
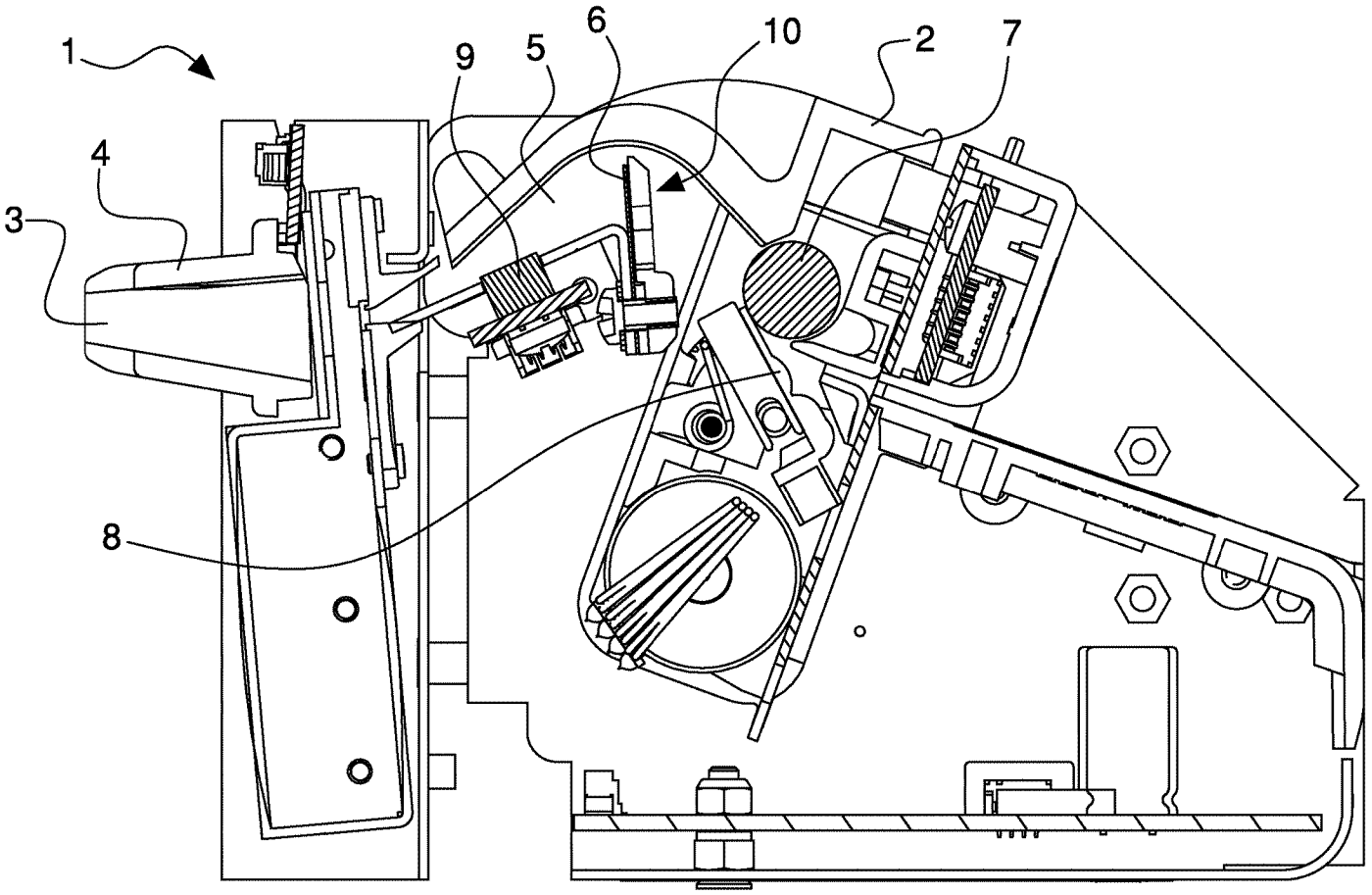
FIG. 1 is a section in vertical elevation of an embodiment of the apparatus in question.
Figure 2:
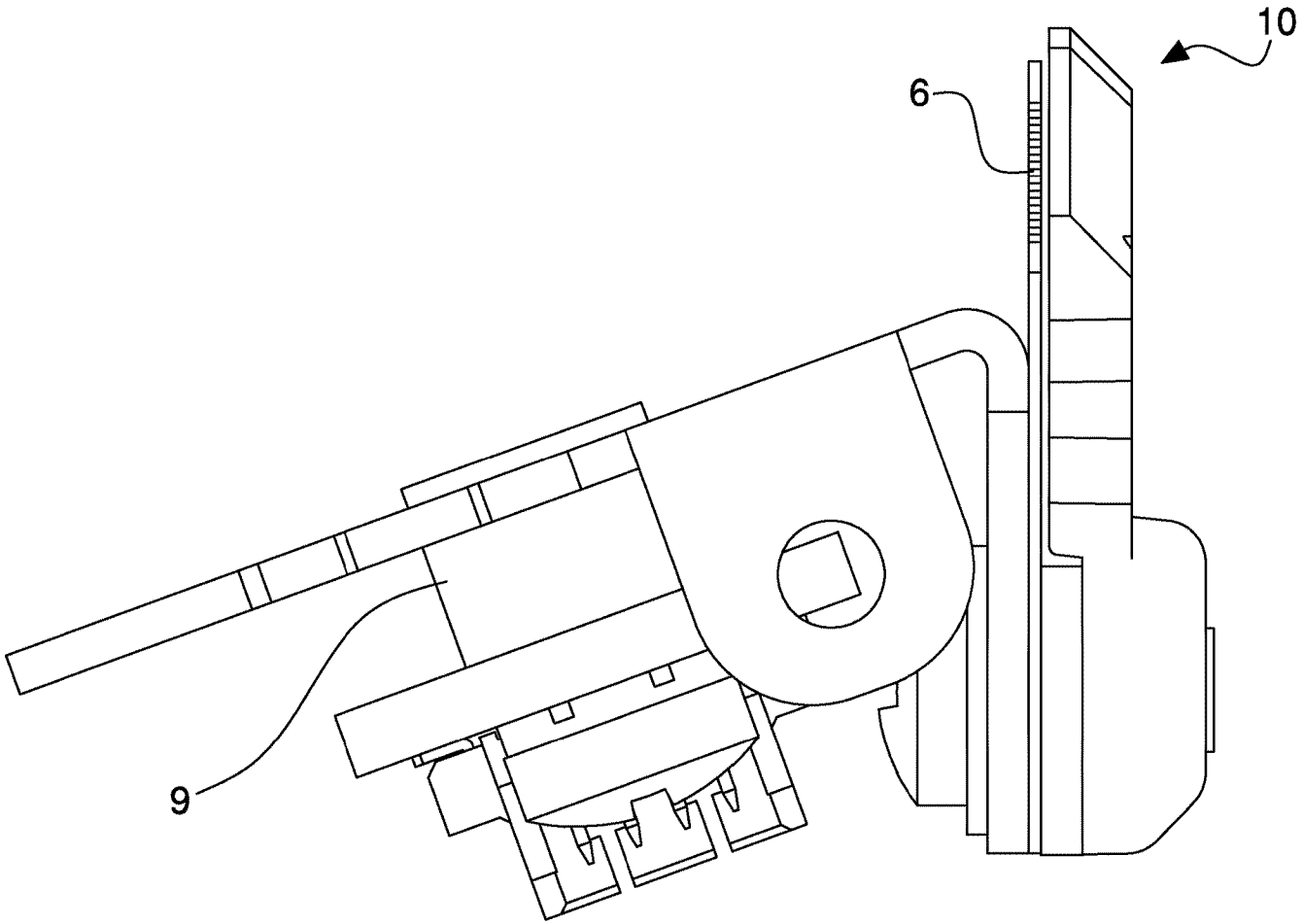
FIG. 2 is an enlarged detail of FIG. 1.
Figure 3:
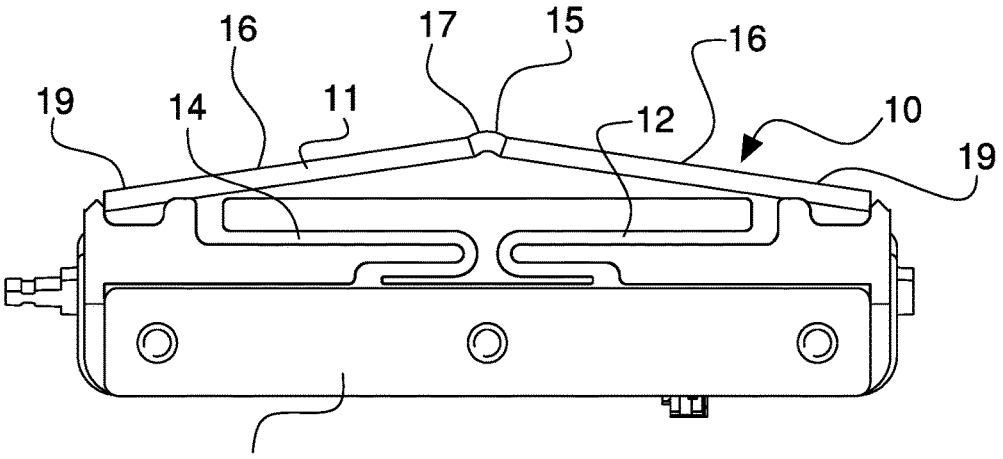
FIG. 3 is a right-hand view of FIG. 2.
Figure 4:
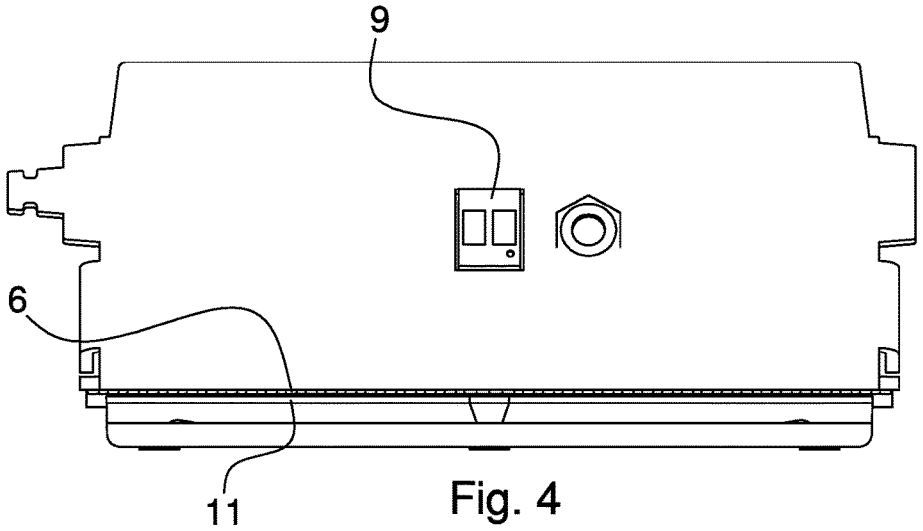
FIG. 4 is a top view of FIG. 2.

With reference to the aforesaid figures, with 1 overall a cutting apparatus was indicated comprising a housing 2 having an outlet 3 from which a user can receive a strip of material, in particular paper material or material similar to paper. The housing 2 is intended, in particular, for containing the various elements of the cutting apparatus which will be disclosed below. The housing 2 can have, for example, a substantially box shape. The outlet 3 can comprise, for example, a slit (arranged horizontally) that is suitable for the passage of the strip and is obtained in an outlet mouth 4 arranged on a front wall of a dispenser of tickets and/or receipts.

The cutting apparatus 1 is used, in particular, for separating, intermittently, receipts, tickets or similar objects (for example receipts or tickets printed in real time just before cutting) from a continuous strip of relatively long material. The cutting apparatus 1 can be used in combination with a printing device in the context of a distributor or dispenser of receipts and/or tickets printed from a continuous strip (of paper or a similar material). The cutting apparatus 1 can be used, for example, in a distributor of receipts and/or tickets situated in a public place. In the specific case the cutting apparatus 1 is used in a self-service fuel dispenser that automatically generates a payment receipt for the customer.

In the specific example the cutting apparatus 1 includes a supply path 5 for supplying the continuous strip. This path 5 will be at least partially arranged inside the housing 2. The strip may advance to the outlet 3 guided to follow the supply path 5. The continuous strip will be, in particular, guided by a guiding device including, for example, fixed (shaped) guiding walls that convey the strip. On the path 5 a roller guiding element (of known type) may also be provided. In particular, the continuous strip may be supplied from a magazine (for example a roller or a reel).

The cutting apparatus 1 comprises a stationary blade 6 arranged for cutting the strip along the supplying path 5. In particular, the stationary blade 6 will be arranged upstream (with reference to an advancing direction of the strip along the path 5) of the outlet 3. The stationary blade 6 may have a cutting edge (for example serrated or of another type) extending transversely (perpendicularly) to the advancing direction of the strip (in particular to the advancing direction that will have the strip at the blade 6). The supplying path 5 for supplying the strip may comprise, at the stationary blade 6, a curve with the internal side facing the blade 6.

The cutting apparatus 1 may further include a supply device for supplying the strip intermittently along the supply path 5. In particular, the supply device will advance the strip until at least an end thereof exits the outlet 3. This outlet may, in particular, be grasped by the user to pull and thus tension the strip and separate the ticket or receipt. Cutting the strip to separate the receipt or the ticket will in fact be caused by the user, who will tension the strip, pulling the end thereof that exits the outlet. The supply device may be arranged, as in this case, along the supply path upstream of the blade, in such a manner that the supply device is not able to tension the strip downstream of the blade. In the specific case, there is no strip-dragging device arranged downstream of the blade 6, i.e. arranged between the blade 6 and the outlet 3.

The supply device may include, as in the example disclosed here, a printing device (in particular a thermal printing device) having at least one strip-advancing roller 7. In the specific case the printing device further includes a (thermal) printing head 8 cooperating with the strip-advancing roller 7 and opposite the latter. The strip will pass, with intermittent motion, between the printing head 8 and the strip-advancing roller 7, to print (in real time) the receipt or ticket. The printing device will be governed by a programmable electronic control unit that will guide intermittent advancement during printing.

The cutting apparatus 1 may comprise, as in this case, a paper end sensor 9, for example a contactless sensor (optical, electromagnetic, etc sensor). In the specific case the paper end sensor 9 comprises a photocell. The paper end sensor 9 may be arranged between the stationary blade 6 and the outlet 3.

The cutting apparatus 1 includes a disengaging device for detaching, after cutting, the (cut) front margin of the strip from the cutting edge of the blade 6. This disengaging device operates for scraping the cutting edge after cutting of the strip and thus ensuring the detachment of the strip from the blade.

This disengaging device may include at least one elastically movable element 10 having a cutting edge scraping device. The scraping device includes a non-cutting edge (or scraping edge) that extends in length adjacent to and alongside the cutting edge. The movable element 10 may be arranged, as in this case, (immediately) upstream of the stationary blade 6 (adjacent thereto) with reference to the advancing direction of the strip to the outlet 3. The non-cutting edge, or scraping edge, may extend in length parallel to or almost parallel to the cutting edge (to the entire length of the cutting edge or at least for most of this length), i.e. the non-cutting edge may be arranged in such a manner as to have the component thereof parallel to the cutting edge that is greater (for example one, two, three or four times or even more) than the transverse component thereof (which could be negligible) on the cutting edge. The non-cutting edge may extend in length transversely to the advancing direction of the strip. The length of the non-cutting edge may be substantially equal (or just a little greater) than the length of the cutting edge in such a manner as to perform the scraping function on the entire, or almost the entire, length of the cutting edge.

The edge of the movable element 10 is called non-cutting although it cannot be excluded that, in certain situations, the strip may undergo a cutting action, albeit minimal, by this non-cutting edge. This edge is called non-cutting because, owing to its conformation and arrangement, it exerts a cutting action that is nil or is almost insignificant or anyway (much) less than that exerted by the cutting edge of the blade 6.

The (scraping) non-cutting edge may comprise a proximal corner, adjacent to the stationary blade, of an external side of the movable element. The proximal corner may have an acute angle (bevelled or rounded). The external side of the non-cutting edge may be inclined (for example bevelled at 45° as in this case) with the inclination facing the path of the strip to facilitate sliding without tearing of the strip. The external side of the non-cutting edge may have a distal corner, opposite the proximal corner and more distant than the latter from the stationary blade, which may be at an obtuse angle.

The movable element 10 may have the possibility of adopting a protruding position, in which at least one part of the non-cutting edge will protrude beyond the cutting edge of the blade 6, and a recessed position, in which the aforesaid part of the non cutting edge will have become recessing and/or flush compared with the cutting edge.

In particular, the movable element 10 is normally in the protruding position through the effect of the elastic action, and, in use, can be pushed by the strip (through contact) from the protruding position to the recessing position, in particular when the strip is tensioned by the user during cutting. The movable element 10 will return elastically to the protruding position, after cutting of the strip, pushed by an elastic device, to ensure that the just cut margin of the strip is actually detached from the cutting edge.

The movable element 10, when it is located in the protruding position, does not tension the strip. It is in fact not configured for tensioning the strip (for example during advancement of the strip), but is configured for being moved (to the recessing position or flush position) by the strip tensioned (manually) by the user.

In the specific example, the cutting edge has a maximum protrusion zone at which strip cutting commences. In particular, the maximum protrusion zone 18 of the cutting edge may comprise a central zone of the cutting edge, for example a pointed zone. The cutting edge may overall have (as in the example) an upturned V shape in which the apex of the V forms the zone of maximum protrusion (central and pointed). The cutting edge may have different shapes, for example an upturned U shape, giving rise to a rounded central zone of maximum protrusion. The zone of maximum protrusion could be arranged not in the centre but, for example, at a (side) end of the cutting edge, which in this case will be tilted (and, for example, rectilinear) with respect to the advancing direction of the strip.

The non-cutting edge may have a maximum protrusion zone 15. This maximum protrusion zone of the non cutting edge could be placed at the possible maximum protrusion zone of the cutting edge. In the specific case, the maximum protrusion zone of the non cutting edge comprises a central zone 17 of the non-cutting edge. This central maximum protrusion zone is, in particular, arranged at the central maximum protrusion zone of the cutting edge. In this case the non cutting edge substantially has the shape of an upturned V, in which the (rounded) apex of the V gives rises to the maximum protrusion zone 115 of the non-cutting edge.

The non-cutting edge may be shaped, as in the example disclosed here, in such a manner that in the recessing position the maximum protrusion zone (central zone) thereof is substantially flush with the maximum protrusion zone of the cutting edge, whereas at least another zone 19 of the non-cutting edge (lateral zones), far from the maximum protrusion zone thereof, is not flush but recessing with respect to the cutting edge. In particular the central zone of the non cutting edge will be arranged substantially flush with the central zone of the cutting edge, whilst the side zones 16 (to the right and the left) will not be flush but recessing with respect to the side zones of the cutting edge, i.e. at a certain distance therefrom. In the specific example the non-cutting edge, in the recessing position, is shaped in such a manner as to be recessing with respect to the cutting edge in a progressively increasing manner from the maximum protrusion zone 15 through the side zones 16 to the edge zones 19. In particular, the non cutting edge will have an upturned V shape with an angle that is greater than the upturned V of the cutting edge.

The movable element 10 may have, as in this case, a side that at least partially faces the stationary blade 6, with an external surface that extends at least mainly on a lying plane, in particular a plane that is normal to the advancing direction of the strip. The stationary blade 6 may be of substantially laminar shape (extending prevalently on a plane), with at least one side (at least partially facing the side of the movable element 10) having an external surface that extends at least prevalently on a lying plane.

In the example disclosed here, when the movable element 10 is in the aforesaid protruding position, at least a portion of flat side of the movable element is adjacent and faces parallel to at least a portion of the flat side of the stationary blade 6. The movable element 10 may be secured, as in this case, to perform a translation movement from the protruding position to the recessing position according to a direction that is parallel to the aforesaid flat sides, such as to maintain the aforesaid flat sides adjacent and facing parallel to one another. The aforesaid portions of the flat sides of the movable element 10 and of the stationary blade 6 (facing one another) bound, respectively, the non cutting edge and the cutting edge.

The movable element 10 may be secured to perform a translation movement parallel to the lying plane of the (flat) stationary blade 6 and/or transverse to the cutting edge. In particular, the movable element 10 comprises a stiff body 11 (of elongated shape) that bears the non cutting edge and is movable (translating) on a movement plane that can be transverse to the advancing direction of the strip and/or transverse to the longitudinal extent of the stiff body 11.

The stiff body 11 may be supported elastically by an elastic device that permits the (linear) movement of the stiff body 11 on the movement plane. Such an elastic device may include, for example, one bending elastic first arm 12 having a first end that is integral with a fixed base 13 (the fixed base will be integral with the housing 2) and a second end that is integral with the stiff body 11. This second end is arranged, in particular, in a side portion of the stiff body 11 that is far from a central portion at which the central zone (of maximum protrusion) of the non-cutting edge is located. The first arm 12 may be extended along the transverse plane in which the stiff body 11 is movable.

The first arm 12 may have a folded shape with at least one intermediate zone in which a curve is present (the curve being arranged near the central portion of the stiff body 11), which gives rise to a hinge. This hinge will have a rotation axis that is transverse (perpendicular) to the lying plane of the stationary blade. In particular, the first arm 12 comprises two arm portions (substantially rectilinear) that are at least partially superimposed on one another (extending in the aforesaid transverse plane) and movable with respect to one another around the aforesaid hinge.

The elastic device may include a bending elastic second arm 14 having a first end that is integral with the fixed base 13 and a second end that is integral with the stiff body 11. This second end is arranged, in particular, in a side portion of the stiff body 11 (opposite the side portion in which the second end of the first arm 12 is located) which is distant from the aforementioned central portion of the stiff body 11.

The second arm 14 may be extended along the aforesaid movement plane of the stiff body. The second arm 14 may have at least one curved intermediate zone that gives rise to a hinge with a rotation axis that is transverse (perpendicular) to the lying plane of the (flat) stationary blade 6. In particular the second arm 14 may comprise two (rectilinear) arm portions that are at least partially superimposed on one another and are movable in relation to one another around the aforesaid hinge. The second arm 14 may be, as in this case, of symmetrical conformation with respect to the first arm 12 around a plane of symmetry that is normal to the lying plane of the stationary blade and/or normal to the length of the stiff body 11 and passing through the centre of the latter.

In the specific example disclosed here, the stiff body 11, the first arm 12, the fixed base 13 and the second arm 14 are constructed integrally of a sole piece of plastics made by moulding.

Figure 5:
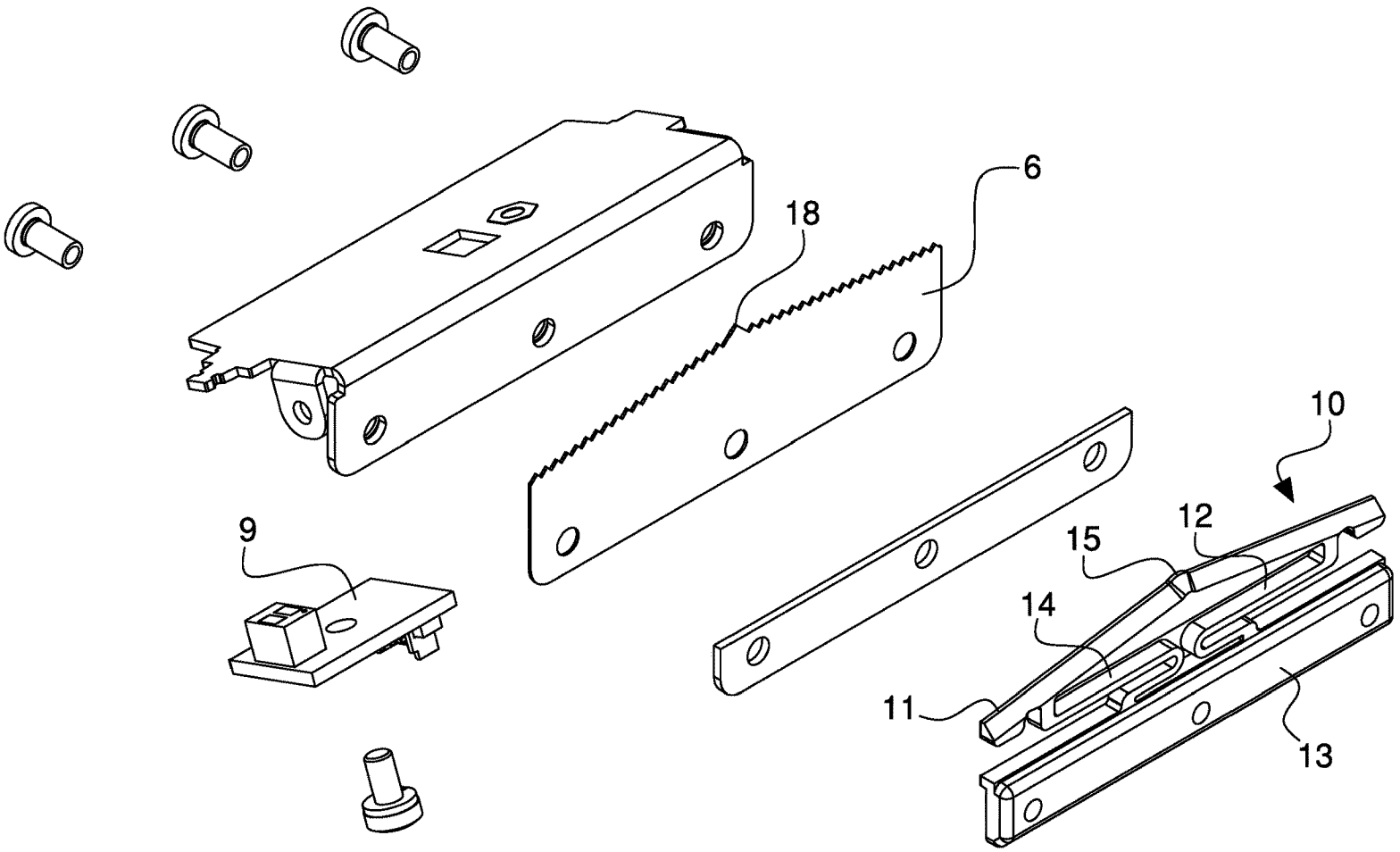
FIG. 5 is an exploded of FIG. 1.

The exploded view in FIG. 5 shows the mounting assembly (using fixing screws) on a support device (integral with the housing 2) of the blade 6, of the sensor 9 and of the base 13 bearing the movable element 10.

In use, when the user pulls the strip end that protrudes outside the outlet 3, the strip is tensioned and consequently the movable element 10 is lowered by the strip that operates in contrast with the elastic support device of the movable element. The element 10 will go to the position that is recessed and/or flush with the stationary blade 6, while cutting the tensioned strip to form the receipt or ticket that can be removed by the user. At this point, the elastic device will lift the movable element 10, returning it automatically to the protruding position. If the cut margin of the strip remained attached to the cutting edge of the blade 6, this elastic movement of the movable element 10 would cause the strip to disengage from the blade through the effect of scraping by the non-cutting edge. In this manner the next receipt or ticket can be dispensed securely and regularly without the risk of kinking.

In the example disclosed, the disengaging device (movable element 10) is not arranged to maintain the strip tensioned but it is the strip that, tensioned by the user, operates in such a manner as to move the disengaging device. The latter, after cutting of the strip, i.e. when the strip is no longer tensioned by the user, moves elastically to scrape the blade.

The invention claimed is:

1. A cutting apparatus, comprising:

a housing having an outlet from which a user can receive a strip of material;

a supply path that is at least partially arranged within said housing along which the strip advances to said outlet;

a stationary blade for cutting the strip along said path upstream of said outlet, said stationary blade including a flat side and a cutting edge extending upwardly from said flat side in an upturned V shape and transversely to an advancing direction of the strip;

a supply device for supplying the strip along said supply path until an end thereof exits said outlet, cutting of the strip being caused by the user who tensions the strip across said cutting edge by pulling an end of the strip exiting said outlet;

at least one unitary movable element including a fixed base connected with said stationary blade, an elastic device, and a stiff body supported by said elastic device, said stiff body having a flat side that is parallel to and abuts against said flat side of said stationary blade and terminating in an upper scraping edge that extends adjacently to and alongside said cutting edge in a transverse direction relative to the advancing direction of the strip, said scraping edge extending with an upturned V shape lying in said transverse direction, said scraping edge including a maximum protrusion zone corresponding with an apex of said upturned V shape that protrudes further than other zones of said scraping edge in said transverse direction, said stiff body adopting a protruding position wherein at least said maximum protrusion zone of said scraping edge protrudes beyond said cutting edge, and a recessed position wherein at least said maximum protrusion zone of said scraping edge is recessed and/or flush relative to said cutting edge;

wherein an angle of said upturned V shape of said scraping edge is greater than an angle of said upturned V shape of said cutting edge; and wherein said movable element is pushed by the strip from said protruding position to said recessed position when the strip is tensioned by the user during cutting, said movable element returning elastically to said protruding position after the strip is cut to ensure that a margin of the strip that has just been cut is disengaged from said cutting edge by said scraping edge.

2. Apparatus according to claim 1, wherein said maximum protrusion zone of said scraping edge comprises a central zone of said scraping edge.

3. Apparatus according to claim 1, wherein said maximum protrusion zone of said scraping edge corresponds with a maximum protrusion zone of said cutting edge at which cutting of the strip starts.

4. Apparatus according to claim 3, wherein said scraping edge is shaped to adopt a recessed position wherein the maximum protrusion zone of said scraping edge is flush with the maximum protrusion zone of the cutting edge.

5. Apparatus according to claim 4, wherein, in said recessed position, said scraping edge has at least one edge zone that is spaced from the maximum protrusion zone of said scraping edge, said at least one scraping edge zone being recessed, with respect to the cutting edge.

6. Apparatus according to claim 4, wherein said scraping edge is recessed with respect to the cutting edge in a progressively increasing distance starting with the maximum protrusion zone of said scraping edge.

7. Apparatus according to claim 1, wherein, in said protruding position, at least one portion of a flat side of said movable element is adjacent and parallel to at least one portion of said flat side of said stationary blade, said movable element being arranged for performing a translation movement from said protruding position to said recessed position according to a direction parallel to said flat side to maintain said at least one portion of said flat side of said movable element and said at least one portion of said flat side of said stationary blade adjacent and facing one another in parallel.

8. Apparatus according to claim 1, wherein said elastic device comprises at least one bending elastic arm having a first end that is integral with said fixed base and a second end that is integral with said stiff body, said elastic arm being arranged in a transverse direction relative to the advancing direction of the strip, said elastic arm having at least two arm portions that are joined together in a curved intermediate zone that defines a hinge.

9. Apparatus according to claim 8, wherein said elastic device comprises a pair of elastic arms.

10. Apparatus according to claim 1, wherein said supply device comprises at least one strip-advancing roller arranged opposite a printing device.

11. Use of an apparatus according to claim 1, together with a printing device, for distributing receipts or tickets printed from a continuous strip of material.

12. Apparatus according to claim 1, wherein said supply device supplies the strip intermittently along said supply path, said supply device being arranged along said path upstream of said stationary blade without tensioning the strip downstream of said stationary blade.

* * * * *